US007500514B2

(12) United States Patent
Heine

(10) Patent No.: US 7,500,514 B2
(45) Date of Patent: Mar. 10, 2009

(54) COOLANT RADIATOR FOR A MOTOR VEHICLE

(75) Inventor: Reinhard Heine, Remseck (DE)

(73) Assignee: Behr GmbH & Co. KG, Stuttgart (DE)

( * ) Notice: Subject to any disclaimer, the term of this patent is extended or adjusted under 35 U.S.C. 154(b) by 112 days.

(21) Appl. No.: 10/575,465

(22) PCT Filed: Sep. 13, 2004

(86) PCT No.: PCT/EP2004/010189

§ 371 (c)(1),
(2), (4) Date: Apr. 12, 2006

(87) PCT Pub. No.: WO2005/038381

PCT Pub. Date: Apr. 28, 2005

(65) Prior Publication Data

US 2007/0131397 A1 Jun. 14, 2007

(30) Foreign Application Priority Data

Oct. 16, 2003 (DE) ..... 103 48 699

(51) Int. Cl.
*F28F 9/00* (2006.01)

(52) U.S. Cl. ..... 165/140; 165/178; 165/916

(58) Field of Classification Search ..... 165/140, 165/178, 916
See application file for complete search history.

(56) References Cited

U.S. PATENT DOCUMENTS

| | | | | |
|---|---|---|---|---|
| 2,281,154 | A * | 4/1942 | Hromadko | 165/140 |
| 2,505,790 | A * | 5/1950 | Panthofer | 165/140 |
| 4,538,679 | A * | 9/1985 | Hoskins et al. | 165/140 |
| 4,665,972 | A * | 5/1987 | Potier | 165/140 |
| 5,113,930 | A * | 5/1992 | Le Gauyer | 165/140 |
| 5,121,790 | A * | 6/1992 | Persson | 165/140 |
| 5,671,803 | A * | 9/1997 | Tepas et al. | 165/140 |
| 6,012,512 | A * | 1/2000 | Ghiani | 165/140 |
| 6,082,449 | A * | 7/2000 | Yamaguchi et al. | 165/167 |
| 6,173,766 | B1 * | 1/2001 | Nakamura et al. | 165/140 |
| 6,283,200 | B1 | 9/2001 | Sugimoto et al. | |
| 6,607,025 | B2 * | 8/2003 | Gille | 165/140 |
| 6,622,783 | B2 * | 9/2003 | Hitt et al. | 165/140 |
| 6,899,167 | B2 * | 5/2005 | Martins et al. | 165/140 |
| 2001/0013407 | A1 * | 8/2001 | Doko et al. | 165/140 |

FOREIGN PATENT DOCUMENTS

| | | | |
|---|---|---|---|
| DE | 43 08 858 | A1 | 9/1994 |
| DE | 103 03 542 | A1 | 8/2003 |
| EP | 0 866 300 | B1 | 9/1998 |
| EP | 0 932 011 | B1 | 7/1999 |
| FR | 2 521 277 | | 8/1983 |
| FR | 2 549 593 | A1 | 1/1985 |
| JP | 2000-018877 | A | 1/2000 |

* cited by examiner

*Primary Examiner*—Leonard R Leo
(74) *Attorney, Agent, or Firm*—Foley & Lardner LLP

(57) ABSTRACT

The invention relates to a coolant radiator for a motor vehicle, comprising a radiator block (2) made of tubes and ribs, a coolant inlet area (5) comprising a coolant inlet pipe connection (7), a cooling agent outlet area (6) comprising a cooling agent outlet pipe connection (8), wherein an oil radiator provided with oil connections (10, 11) which are guided out from the cooling agent area (6) is arranged. According to the invention, the coolant outlet connection (8) is arranged between the oil connections (10, 11).

5 Claims, 2 Drawing Sheets

COOLANT RADIATOR FOR A MOTOR VEHICLE

FIELD OF THE INVENTION

The invention relates to a coolant radiator for a motor vehicle.

BACKGROUND OF THE INVENTION

Coolant radiators for motor vehicles with an integrated oil cooler are known, for example from EP-A 0 866 300, DE-A 101 06 515 or DE-A 103 03 542 belonging to the Applicant. The oil cooler or another auxiliary heat exchanger is arranged in one of the coolant boxes, preferably in the coolant outlet box, and its outer face is cooled by the coolant that flows across it. Known oil coolers (DE-C 43 08 858) are designed as disk-type, plate-type or flat tubular heat exchangers. They have an oil inlet pipe connection and an oil outlet pipe connection which are inserted through corresponding openings in the wall of the coolant box and are sealed off. The oil connections are therefore arranged on the outer face of the coolant boxes, which likewise have a coolant inlet or outlet pipe connection. In known cross-flow coolers, in which the coolant tubes are horizontal and the coolant boxes are arranged vertically, the coolant inlet pipe connection is situated at the top on the inlet box, and the coolant outlet pipe connection is arranged at the bottom on the outlet box, so that the flow through the tube/rib block is virtually diagonal. The coolant is able to collect before the outlet pipe connection and is sucked from there by the coolant pump. The oil cooler is therefore arranged above the outlet pipe connection, i.e. the oil inlet and outlet pipe connections are located above the coolant outlet pipe connection. An arrangement of the coolant outlet pipe connection in the lower box area is sometimes not possible, and in this case the outlet pipe connection has been arranged above the integrated oil cooler and its oil connections. In principle, the coolant outlet pipe connection is therefore located outside the oil cooler area and its oil connections. This arrangement has the result that the spacing of the oil connections is relatively small or has to be reduced, depending on the size of the coolant box. In order to provide the required oil cooler efficiency, it is therefore necessary either to increase the number of flow channels (disks, flat tubes), i.e. also make the coolant box higher, or to make the disks or flat tubes wider, which results in a widening of the coolant box or the tube plate. In terms of cost, an oil cooler with a small number of disks and a large spacing of the pipe connections is more favorable.

SUMMARY OF THE INVENTION

The object of the present invention is to improve a coolant radiator, of the type mentioned at the outset, in terms of the arrangement of the auxiliary heat exchanger in the coolant box, so that the entire radiator including oil cooler or auxiliary heat exchanger can be produced cost-effectively and can be better adapted to the installation conditions.

According to the invention, a coolant pipe connection is arranged between the connections of the auxiliary heat exchanger. This affords the advantage that, for a predetermined coolant box, a greater spacing of the pipe connections of the auxiliary heat exchanger is obtained, i.e. longer and thus fewer tubes or disks are required. This lowers the costs of the auxiliary heat exchanger. An inner length of the coolant box can thus be utilized almost completely for the length of the auxiliary heat exchanger.

In an advantageous embodiment of the invention, the auxiliary heat exchanger is displaced inside the cross section of the coolant box in such a way that the distance to the coolant pipe connection is increased. This affords the advantage of improved coolant flow, in particular improved coolant outlet flow, because the coolant can better collect on an inlet side or outlet side of the oil cooler as a result of the increased distance. Thus, gaps of different sizes are obtained between a front wall and a rear wall of the coolant box, as a result of which the flow through the auxiliary heat exchanger and the flow from or to the coolant box is improved. The coolant-side drop in pressure is thus favorably affected.

According to an advantageous embodiment of the invention, the coolant pipe connection is arranged approximately at the center between the oil pipe connections, which results in a coolant flow that is symmetrical and therefore subject to less loss. On the other hand, given appropriate installation requirements, arrangements of the coolant pipe connection outside the center between the oil pipe connections may also be advantageous.

According to an advantageous embodiment of the invention, the wall of the coolant box, i.e. the wall in which the coolant pipe connection and the pipe connections of the auxiliary heat exchanger are arranged, is bulged slightly outward. This has the advantage of favorable flow of coolant from or to the pipe connection. Moreover, in the arrangement of the coolant pipe connection according to the invention, another advantage is that the cross section of the auxiliary heat exchanger can be made smaller (because the spacing of the pipe connections is greater and the tubes are longer), and thus a smaller part of the cross section of the coolant box is taken up by the auxiliary heat exchanger. The flow around and through the auxiliary heat exchanger is also improved in this way.

According to an advantageous embodiment of the invention, the coolant boxes are designed as plastic injection-molded parts. However, radiators made entirely of metal are also possible, in which the coolant boxes are also made of metal, preferably aluminum, as is described in the prior art cited in the introduction.

An oil cooler can be used for example as the auxiliary heat exchanger in the coolant box.

BRIEF DESCRIPTION OF THE DRAWINGS

An illustrative embodiment of the invention is shown in the drawing and is described in more detail below. In the drawing.

DETAILED DESCRIPTION OF THE INVENTION

Figure 1:
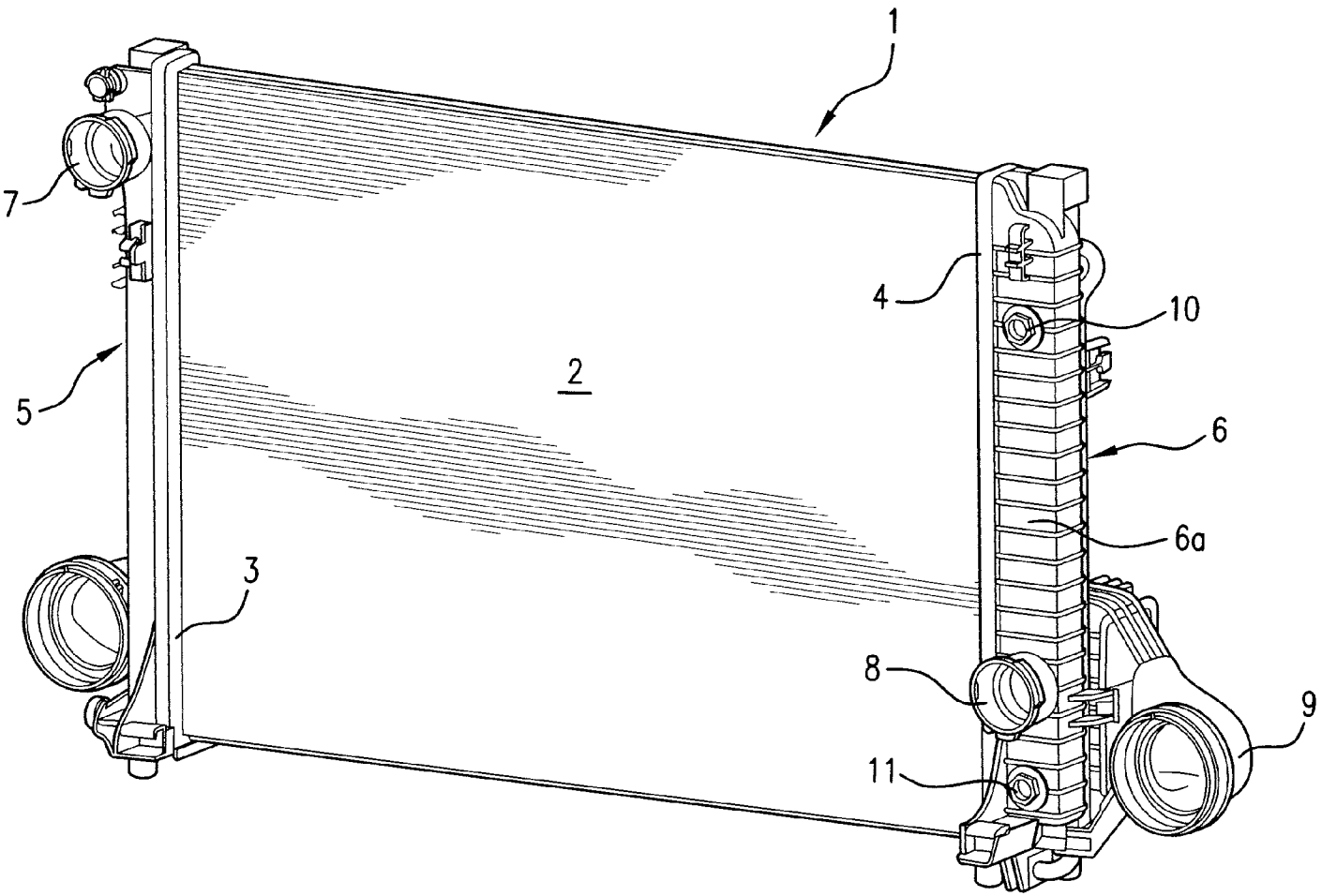
FIG. 1 shows a coolant radiator with integrated oil cooler.

FIG. 1 shows a coolant radiator/air cooler 1 which is designed as a cross-flow cooler and, in the position shown, is installed in the engine space of a motor vehicle (not shown). The coolant radiator 1 has a radiator block 2 made up of tubes and ribs (not shown), the tubes being arranged horizontally and soldered to the ribs to form a solid block. The ends of the tubes are connected to tube plates 3, 4 onto which coolant boxes 5, 6 are fitted and mechanically connected. The coolant boxes 5, 6 are preferably produced as injection-molded parts.

The left-hand coolant box 5 in the drawing has, in its upper area, a coolant inlet pipe connection 7, while, on the coolant outlet box 6 situated to the right in the drawing, an outlet pipe connection 8 is arranged in the lower area, but not in the very lowest area. A charge-air cooler 9, which for the most part is covered, is connected to the coolant boxes 5, 6. The coolant radiator 1 is part of a cooling module (not shown completely) and is joined via its coolant pipe connections 7, 8 to a coolant circuit (not shown) of the internal combustion engine of the motor vehicle. In the right-hand coolant box 6, the outlet box, an oil cooler (not shown) is arranged which has two oil connections in the form of oil pipe connections 10, 11 which project out from the coolant box 6, i.e. from its rear wall 6*a*, and are sealed off relative to the rear wall. Oil that is to be cooled, for example transmission oil of an automatic transmission (not shown), is fed to the oil cooler via the pipe connection 10 (or 11), and the cooled oil is removed via the pipe connection 11 (or 10).

Figure 2A:
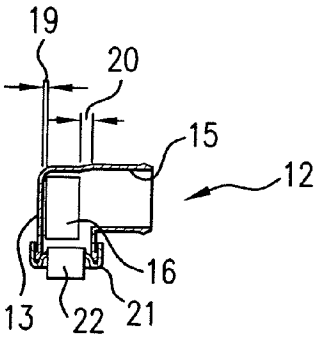
FIG. 2*a* shows a cross section through the coolant box.
Figure 2:
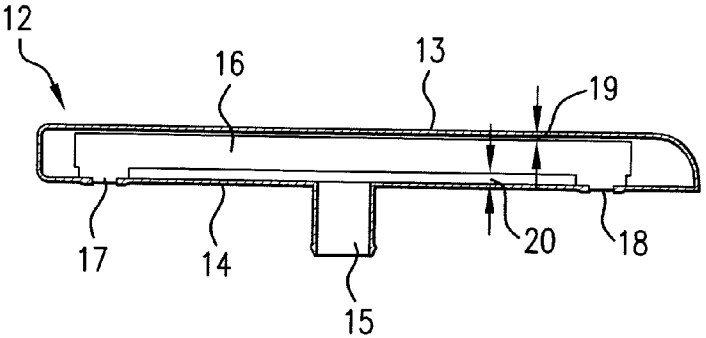
FIG. 2 shows a section through a coolant box with a transmission oil cooler.

FIG. 2 shows a section through a coolant box 12 which has a front longitudinal wall 13 and a rear longitudinal wall 14 in the center of which a coolant outlet pipe connection 15 is arranged. Arranged in the inside of the coolant box 12 there is an oil cooler 16 which for example is made up of flat tubes or disks (not shown), as described in the prior art cited in the introduction, and is held in the coolant box 12 via an inlet pipe connection 17 and an outlet pipe connection 18 and sealed off. A front gap 19 is arranged between the front wall 13 and the oil cooler 16, and a rear gap 20 is arranged between the rear wall 14 and the oil cooler 16, the rear gap 20 being considerably larger than the front gap 19. This results in a better flow of coolant through the oil cooler 16, and the coolant, after emerging from the oil cooler 16, can better collect in the enlarged gap 20 and flow to the outlet pipe connection 15.

FIG. 2*a* shows a cross section through the coolant box 12 in the area of the pipe 15, the oil cooler 16 being depicted schematically as a rectangular section. It will also be seen here that the front gap 19 is much smaller than the rear gap 20, i.e. the oil cooler 16 has been displaced from the center toward the front wall 13. This results in favorable through-flow and outflow conditions on the coolant side. The coolant box 12, again made of plastic, is fitted onto a metal tube plate 21 and mechanically connected to the latter. A tube end 22 of a flat tube (not shown) is received in the tube plate 21. As has already been mentioned, the tubes, the corrugated ribs and the tube plate are soldered together to form a metal block. The direction of air flow is indicated by an arrow L.

Figure 3A:
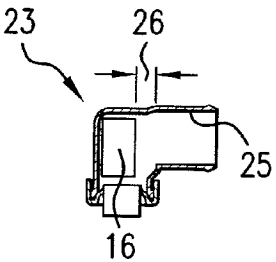
FIG. 3*a* shows a cross section through the coolant box.
Figure 3:
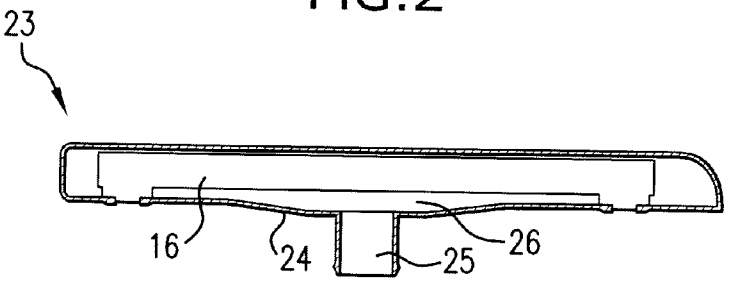
FIG. 3 shows a section through a coolant box with bulged wall.

FIG. 3 shows a further embodiment of a coolant box 23 which is designed similarly to the coolant box 12 according to FIG. 2, but has an outwardly bulged rear wall 24 in which the coolant outlet pipe connection 25 is arranged. An enlarged gap 26 is thus obtained between the oil cooler 16 (the same way as in FIG. 2) and the rear wall 24, as a result of which the outflow conditions for the coolant are further improved.

FIG. 3*a* shows the coolant box 23 in cross section in the area of the outlet pipe connection 25. The gap 26 is further enlarged here compared to the gap 20 in the embodiment according to FIGS. 2 and 2*a*.

Figure 4:
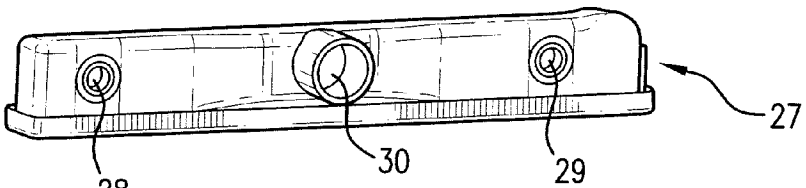
FIG. 4 shows a 3D representation of a coolant box.

FIG. 4 shows a 3D representation of a coolant box 27 with oil connections 28, 29 and, arranged between these, coolant outlet pipe connection 30. It will be seen here, as also in the illustrative embodiments according to FIGS. 1, 2 and 3, that practically the entire length of the coolant boxes is utilized for the length of the oil cooler, as a result of which the latter can be produced cost-effectively.

The invention claimed is:

1. A coolant radiator for a motor vehicle comprising:

a radiator block comprising tubes and ribs, a coolant inlet box comprising a coolant inlet pipe connection, and a coolant outlet box comprising:

a front wall, a rear wall, a coolant outlet pipe connection arranged in the rear wall, an oil cooler comprising two connections guided out from the coolant outlet box arranged in the rear wall, a front gap between the oil cooler and the front wall, and a rear gap between the oil cooler and the rear wall, wherein the rear gap is larger than the front gap, wherein the coolant outlet pipe connection is arranged between the two connections of the oil cooler and wherein the rear wall is bulged outward in the area around the coolant pipe connection.

2. The coolant radiator as claimed in claim 1, wherein the outlet pipe connection is arranged approximately at the center between the connections of the oil cooler.

3. The coolant radiator as claimed in claim 1, wherein the coolant boxes are designed as plastic injection-molded parts.

4. The coolant radiator as claimed in claim 1, wherein the oil cooler is designed as a disk-type, flat tubular or plate-type radiator.

5. The coolant radiator as claimed in claim 1, wherein the rear gap is considerably larger than the front gap.

* * * * *